US005704002A

United States Patent [19]

Massaloux

[11] Patent Number: 5,704,002

[45] Date of Patent: Dec. 30, 1997

[54] PROCESS AND DEVICE FOR MINIMIZING AN ERROR IN A SPEECH SIGNAL USING A RESIDUE SIGNAL AND A SYNTHESIZED EXCITATION SIGNAL

[75] Inventor: Dominique Massaloux, Perros-Guirec, France

[73] Assignee: France Telecom Etablissement autonome de droit public, Paris, France

[21] Appl. No.: 205,570

[22] Filed: Mar. 4, 1994

[30] Foreign Application Priority Data

Mar. 12, 1993 [FR] France ..... 93 02881

[51] Int. Cl.[6] ..... G10L 9/14

[52] U.S. Cl. ..... 395/2.29; 395/2.15; 395/2.16; 395/2.28

[58] Field of Search ..... 395/2.29, 2.1, 395/2.28, 2.32, 2.14, 2.16, 2.2, 2.93, 2.15, 2.33, 2.35, 2.36

[56] References Cited

U.S. PATENT DOCUMENTS

| | | | |
|---|---|---|---|
| 4,776,015 | 10/1988 | Takeda et al. | 395/2.29 |
| 5,027,405 | 6/1991 | Ozawa | 395/2.32 |
| 5,140,638 | 8/1992 | Moulsley et al. | 395/2.28 |
| 5,371,853 | 12/1994 | Kao et al. | 395/2.32 |

FOREIGN PATENT DOCUMENTS

| | | |
|---|---|---|
| 0 443 548 | 8/1991 | European Pat. Off. . |
| 0 523 979 | 1/1993 | European Pat. Off. . |
| WO 91/03790 | 3/1991 | WIPO . |

OTHER PUBLICATIONS

Proceedings of the International Conference on Acoustics, Speech and Signal Processing, Apr. 3–6, 1990, vol. 2, pp. 677–680, K. Ozawa, "A Hybrid Speech Coding Based on Multi–Pulse and Celp at 3.2kb/s".

AEU Archiv fur Elektronik und Ubertragungstechnik, vol. 43, No. 5, Sep. 1989, pp. 307–312, Reininger, et al., "Pradiktive Sprachcodierung Mit Stochastischer Anregung".

Kemp et al, "Multi–Frame Coding . . . ", ICASSP v. 1, May 14, 1991, pp. 609–612, Toronto. Kroon et al, Pitch Predictors . . . , ICASSP 90, 3–6 Apr. 1990, pp.661–664, v. 2, Albuquerque, NM Marques, et al, Pitch Prediction with . . . , Eurospeech 89, 26–28 Sep. 1989, pp. 509–512, v. 2.

Kleijn, et al. "Fast Methods for the CELP speech coding algorithm" pp. 1330–1342, ITASSP, Aug. 1990, 38,8.

*Primary Examiner*—Allen R. MacDonald
*Assistant Examiner*—Donald L. Storm
*Attorney, Agent, or Firm*—Oblon, Spivak, McClelland, Maier & Neustadt, P.C.

[57] ABSTRACT

The present invention relates to a device and process for the digital coding and decoding of speech comprising a short term prediction, a long term prediction and a residual wave coding technique using a synthesis analysis method. The LTP analysis module uses a dictionary of delays having a pseudo-logarithmic structure, in which the delays are arranged in increasing order. This dictionary is constituted by segments, each having a given resolution, the resolutions of the successive segments decreasing geometrically in a rational ratio k>1, while the number of elements of each segment remains constant. The invention defines the use of λ delay elements of said dictionary extending the LTP analysis techniques to high time resolution. The invention also relates to a process for the rapid scanning of such a pseudo-logarithmic delay dictionary. It also relates to a process for implementing a selection criterion of the delay in closed loop with perceptual filtering. The invention also relates to scanning a dictionary of delays and calculating a difference between a residue signal and a synthesized delayed residual, and perceptual filtering the difference.

12 Claims, 10 Drawing Sheets

| $i/S_i$ | $\mu_i$ | $n_i$ | $S_i^o$ | $R_i$ | $\lambda/\lambda_o \in S_i^o$ |
|---|---|---|---|---|---|
| 0 | $\lambda^o_{min}$ | 8 | $\lambda^o_{min}, \ldots, \lambda^o_{min}+7$ | 8 | $\lambda_o-7/8, \lambda_o-3/4, \lambda_o-5/8, \lambda_o-1/8, \lambda_o$ |
| 1 | $\lambda^o_{min}+8$ | 16 | $\lambda^o_{min}+8, \ldots, \lambda^o_{min}+23$ | 4 | $\lambda_o-3/4, \lambda_o-1/2, \lambda_o-1/4, \lambda_o$ |
| 2 | $\lambda^o_{min}+24$ | 32 | $\lambda^o_{min}+24, \ldots, \lambda^o_{min}+56$ | 2 | $\lambda_o-1/2, \lambda_o$ |
| 3 | $\lambda^o_{min}+56$ | 64 | $\lambda^o_{min}+56, \ldots, \lambda^o_{min}+119$ | 1 | $\lambda_o$ |

FIG. 6

PROCESS AND DEVICE FOR MINIMIZING AN ERROR IN A SPEECH SIGNAL USING A RESIDUE SIGNAL AND A SYNTHESIZED EXCITATION SIGNAL

TECHNICAL FIELD

The present invention relates to a device for the digital coding and decoding of speech, a process for scanning a pseudo-logarithmic LTP delay dictionary and a LTP analysis process.

STATE OF THE ART

In known manner, a digital coding device for speech consists, after sampling the analog signal, of performing the compression of the binary data of the digitized speech signal. The decoding device performs the reverse operation and restores a different analog signal from the original signal, but which is as close as possible from the perceptual standpoint.

A digital coding—decoding device for speech is characterized by the digital rate of the data to be transmitted between the coder and the decoder, the quality of the signal restored to the decoder and the complexity of the compression technique used.

Predictive coders are used for relatively low rates (4 to 16 kbit/s for a 8 kHz sampling frequency) and a good coding quality. They combine the properties of the speech signal linked with its production and others linked with its perception by a human listener.

Local stationarity of the speech signal: the speech signal can be predicted on the basis of its recent past (8 to 12 8kHz samples) by means of parameters evaluated on 10 to 20 ms windows. These short term prediction parameters representing the transfer function of the voice are obtained by LPC or Linear Prediction Coding analysis methods.

Periodicity of voiced sounds (e.g. vowels): this longer term correlation is due to the vibration of the vocal cords. The vibration rate (fundamental frequency) varies between 60 and 400 Hz as a function of the speakers. A LTP or Long Term Prediction analysis makes it possible to evaluate the parameters of a long term predictor using this feature.

Masking the noise by the signal: in frequencies close to an energy maximum of the signal, the ear is less sensitive to the coding noise. This property is utilized by the introduction of a "perceptual filter" to the coding of the residual wave from the short and long term predictors and optionally LTP analysis. This filter makes it possible to redistribute the noise in the frequency zones where it is masked by the signal.

Conventionally, a predictive coder is constituted by a short term prediction module, a long term prediction module and then a module performing the coding of the residual wave with the aid of a synthesis-based analysis method, like that described in the article by P. Kroon and B. S. Atal entitled "Predictive Coding of Speech Using Analysis by Synthesis Techniques" (Advances in Speech Signal Processing, Ed. Furui S., Sondhi M. M., pp. 141–164, 1991).

As a function of the residual wave coding type, a distinction can be made between several groups of coders: APC, Multipulse-Excited, CELP and similar coders, as described in the article by P. Kroon and B. S. Atal.

This type of coding device is widely used, mainly in transition systems by terrestrial channels or satellite, or in storage applications.

Different constructions of the LTP module of known types will now be briefly described.

The general form of a long term predictor of order p is:

$$P(Z) = 1 - \sum_{k=0}^{P-1} \beta(k) z^{-(\lambda+k)}$$

The number p of coefficients of this predictor generally varies from 1 to 3. On considering the particular case of first order predictors: $P(Z)=1-\beta z^{-\lambda}$.

On analysis, the parameters $\beta$ and $\lambda$ are determined by minimizing the energy of an error signal e(n) on a block of N samples of the signal x(n):

$$MinE(\lambda) = \sum_{n=0}^{N-1} e(n)^2 \text{ with } e(n) = x(n) - \beta x(n-\lambda) \quad (1)$$

x(n) representing the actual input signal s(n) or the LPC residue r(n). This so-called open loop analysis is described in the article by B. S. Atal entitled "Predictive Coding of Speech at Low Bit Rates" (IEEE Trans. Commun., COM-30, pp. 600–614, April 1982). This type of analysis can advantageously be replaced by a closed loop analysis, anticipating the operation performed in the decoder in order to produce the synthesis signal $\tilde{s}(n)$.

On synthesis we obtain:

$$\tilde{s}(z) = \frac{1}{A(z)} \cdot \frac{1}{P(z)} u(z) \text{ (with } u(n) = \text{excitation signal)}$$

If $$\tilde{e}(z) = \frac{1}{P(z)} \cdot u(z),$$

then $\tilde{e}(n)=u(n)+\beta\tilde{e}(n-\lambda)$ represents the reconstructed residual signal or the synthesis excitation of the LPC filter 1/A(z).

The modelling of the residue r(n) by the signal $\tilde{e}(n)$ is improved when the error signal e(n) of the equation (1) is replaced by:

$$e(n)=r(n)-\beta\tilde{e}(n-\lambda) \quad (2)$$

such as e.g. the RPELTP coder described in the article by P. Vary, K. Hellwig, C. Galand, M. Resso, J. P. Petit, D. Massaloux entitled "Speech Codec for the European Mobile Radio System" (Globecom. pp. 1065–1069, 1986).

The long term predictor described in the article by W. B. Kieijn, D. J. Krasinski and R. H. Ketchum entitled "An Efficient Stochastically Excited Linear Predictive Coding Algorithm for High Quality Low Bit Rate Transmission of Speech" (Speech Commun., vol. VII, pp. 305–316, 1988) adopts a CELP philosophy for a LTP analysis also performed in closed loop manner. With each period is associated a wave form $u_\lambda=\tilde{e}(n-\lambda), n=0\rightarrow N-1$ in a CELP dictionary. This dictionary updated on each LTP analysis is called an adaptive dictionary. The LTP analysis is replaced by the search for the optimum code in the adaptive dictionary resolved by the standard equations of CELP, which amounts to replacing e(n) in equation (1) and (2) by:

$$e(n)=h_g(n)*(r(n)-\beta u_\lambda(n)), n=0\rightarrow N-1$$

with $h_g(n)$ time domain representation of the perceptual filter $$H_g(z) = \frac{A_{\gamma_1}(z)}{A_{\gamma_2}(z)A(z)}$$

-continued $$\left(\text{on choosing } \gamma_1 = 1,\ \gamma_2 = g,\ H_g(z) = \frac{1}{A_g(z)}\right)$$

The target signal t(n) is expressed on the basis of the LPC residue r(n) and the signal $\tilde{e}_p(n)$ obtained by extending the past excitation $\tilde{e}(n)$ by zero samples:

$$t(n) = r(n) - \tilde{e}_p(n)$$

$$n = 0 \rightarrow N-1 \text{ with } \tilde{e}_p(n) = \begin{cases} \tilde{e}(n) & n < 0 \\ 0 & 0 \leqq n < N \end{cases}$$

Then for e(n) we obtain the expression:

$$e(n) = h_g(n) * (r(n) - \tilde{e}_p(n) - \beta u_\lambda(n)) \quad (3)$$

essentially different from the equation (2) by the introduction of the perceptual filter and its memory.

Moreover, the closed loop analyses use the signal $\tilde{e}(n)$, which at the start of the analyzed block is only known for n<0, which makes it necessary to restrict the LTP analysis to the values $\lambda \geqq N$. This restriction reduces the efficiency of a long term predictor on voices having a high fundamental frequency (voices of women and children). It is possible to obviate this by extrapolating the signal $\tilde{e}(n)$ for $n \geqq 0$. In the aforementioned article by W. B. Kleijn, D. J. Krasinski and R. H. Ketchum, use is made of the assumed periodicity of the signal for each candidate period $\lambda$ by replacing $\tilde{e}(n), n \geqq 0$ by $\tilde{e}(n-\lambda)$ if $n<\lambda$ (in which $\tilde{e}(n-k\lambda)$ with k=smallest integer for which $n<k\lambda$). However, for each period $\lambda<N$, it is necessary to complete $\tilde{e}$ with $N-\lambda$ values, which increases the complexity of the LTP analysis.

A certain number of fast algorithms described in the article by W. B. Kleijn, D. J. Krasinski and R. H. Ketchum entitled "Fast Methods for the CELP Speech Coding Algorithm", (IEEE Trans. on ASSP, vol.38, no.8, pp. 1330–1341, August 1990) were designed in order to accelerate calculations in the long term predictor, mainly in the fundamentally more complex analysis by adaptive dictionary. These algorithms are generally disturbed by the introduction of extrapolated elements of $\tilde{e}(n)$.

A final point concerns the precision of the long term predictor. For an order 1 predictor with integral delays $\lambda$, the sought periodicity T is limited to multiples of the sampling period $T_e$. Two methods have been proposed which make it possible to improve the precision on T, namely:

- increasing the order of the predictor, which obviously increases the complexity of the analysis, but also increases the number of gains to be coded;
- using a high time resolution predictor, as described in the article by P. Kroon and B. S. Atal entitled "Pitch Predictors with High Temporal Resolution" (Proc. ICASSP, pp. 661–664, April 1990). This technique uses fractional delays of type $\lambda+\phi/D$ with $\lambda \in N$, $\phi=0.1, \ldots, D-1$by interpolating the analyzed past signal. The interpolation is performed by oversampling followed by a low-pass filtering. This operation can be effectively put into effect by using a polyphase structure, like that described in the article by R. E. Crochière and L. R. Rabiner entitled "Interpolation and Decimation of Digital Signals: A Tutorial Review" ("Proc. of the IEEE" vol.69, no.3, March 1981).

The problem of combining the extrapolation techniques of the signal $\tilde{e}(n)$ and the high time resolution prediction is solved by a complicated recursive process described in patent application WO91:03790 of I. A. Gerson and M. A. Jasiuk entitled "Digital Speech Coder Having Improved Sub-Sample Resolution Long Term Predictor". For each fractional period $\lambda+\phi/D$, the samples $\tilde{e}(n)$, $n \geqq 0$ unknowns are replaced recursively by samples obtained from an interpolation of the past signal $\tilde{e}(n), n<0$.

The object of the invention is a digital device for the coding and decoding of speech, in which the operation of the long term prediction module as defined in the different prior art documents is improved.

DESCRIPTION OF THE INVENTION

For this purpose the invention proposes a device for the digital coding and decoding of speech comprising, on coding, a short term prediction or LPC analysis module, a long term prediction or LTP analysis module, a module for coding the residual wave using a synthesis-based analysis method and on decoding, a module for decoding the residual wave, a LTP synthesis module and a LPC synthesis module, characterized in that the LTP analysis module uses a dictionary of delays having a pseudo-logarithmic structure, in which the delays are arranged in increasing order, said dictionary being constituted by Q adjacent segments, each having a given resolution, the resolutions of the successive segments decreasing geometrically in a rational ratio k such that k>1, whilst the number of elements L of each segment remains constant.

The interest of these nested precisions is to maintain roughly constant the relative precision on the delay and therefore the error on the periodicity of the signal due to the sampling. The invention also makes it possible to obtain a simple and effective coding of the delay.

The resolutions of the delays in the different segments of the pseudologarithmic dictionary are rational $R=p/q$, $p \in N$, $q \in N$ (N: set of natural integers).

For this purpose the high time resolution analysis methods (delays $\lambda=\lambda_1/R$ with $\lambda_1 \in N$, $R \in N$) to the case of fractional resolutions (delays $\lambda=\lambda_1 x q/p, \lambda_1, q, p \in N$).

Advantageously, in a first variant, the delay dictionary is subdivided into Q adjacent segments $S_i (i=0 \rightarrow Q-1)$ having in each case L delays. To each segment $S_i$ corresponds a resolution $R_i$, the resolutions of the successive segments decreasing in a given rational ratio k ($R_i=R_{i-1}/k$). If $\lambda_1$is the final delay of the segment $S_i$, said segment is formed from L delays $\lambda_j=\gamma_i=j/R_i$, $j=L-1 \rightarrow 0$ with $\lambda_j, R_i$ being integers. The adjacency condition between the segments is ensured by $\gamma_{i-1}=\gamma_i-L/R_i, i=1 \rightarrow Q-1$. If one introduces $\lambda_{max}$=final delay of the dictionary and $R_{Q-1}$=resolution of the final segment, it is demonstrated that such a dictionary is entirely defined by giving the values $\{Q, L, k, \lambda_{max}, R_{Q-1}\}$ and the condition $R_{Q-1}, \lambda_{max} \in N$.

In a second variant, the delay dictionary is subdivided into Q adjacent segments $S_i (i=0 \rightarrow Q-1)$, each having L delays. To each segment $S_i$ corresponds a resolution $R_i$, the resolutions of the successive segments decreasing in a given rational ratio k ($R_i=R_{i-1}/k$). If $\beta_i$ is the first delay of the segment $S_i$, said segment is formed from L delays $\lambda_j=\beta_i+j/R_i, j=0 \rightarrow L-1$ with $\lambda_j, R_i$being integers. The adjacency condition between segments is ensured by $\beta_i=\beta_{i-1}+L/R_{i-1} i=1 \rightarrow Q-1$. On introducing $\beta_{Q-i}$=1st delay of the final segment and $R_{Q-1}$=resolution of the final segment, it is demonstrated that such a dictionary is entirely defined by giving the values $\{Q, L, k, \beta_{Q-1}, R_{Q-1}\}$ and the condition $R_{Q-1}, \beta_{q-1} \in N$.

Advantageously, the device permits a coding of the LTP delay which is simple and inexpensive with regards to storage of the type:

according to the first variant:

$$\text{code}(\lambda_j)=L.i+j',$$

$$\text{with } S_j=\{\lambda_j=\gamma_i-j/R_i,\ j=L-1\rightarrow 0\}$$

$$\text{and } j'=L-1-j$$

according to the second variant:

$$\text{code}(\lambda_j)=L.i+j$$

$$\text{with } S_i=\{\lambda_j=\beta_i+j/R_i,\ j=0\rightarrow L-1\}.$$

Advantageously a specific embodiment of a pseudo-logarithmic delay dictionary as defined hereinbefore is the dictionary D, formed by fractional delays, of resolution R=p>1, or integers, which can be described in the following way: each segment $S_i$, $i=0\rightarrow 3$ of resolution $R_1=2^{3-i}$ is formed by delays $\lambda_o-\phi/R_i$, $\phi=0\rightarrow R_i-1$, the integral delay $\lambda_O$ forming a subset $S_i^O$ of $S_i$ having $n_i=2^{i+3}$ elements:

$$S_i^O = \left\{ \lambda_0=\mu_i+j/j=0\rightarrow n_i-1, \text{ with } \mu_i=\lambda_{min}^0+\sum_{j=0}^{i-1} n_j \right\} \text{ (setting } n_{-1}=0)$$

Advantageously, an effective suboptimum procedure for scanning a pseudo-logarithmic delay dictionary as defined in the first or second variants of the invention and making use of the particular structure, makes it possible to considerably reduce the complexity of the search for the best delay:

- in a first pass, a selection takes place of K(i) local maxima of the criterion to be maximized from among a reduced set of α(i) delays of each segment $S_i$;
- in a second pass, the dictionary is scanned in a limited manner in the vicinity of the values selected during the first pass.

Advantageously, the size of the segments L is a multiple of $K^{iL-1}$, the choice for α(0) of $L/k^{iL-1}$ or a submultiple of $L/k^{iL-1}$ introducing a regular spacing of the delays scanned in the first pass.

Advantageously, a supplementary simplification with respect to the search of the first pass is introduced by replacing the maximization of $E'(\lambda)=N(\lambda)^2/D(\lambda)$, in which $N(\lambda)$ and $D(\lambda)$ respectively represent the numerator and the denominator of the optimum gain associated with each delay λ, by that of $N(\lambda)$. Thus, calculation takes place of the local maxima of the intercorrelation $N(\lambda)$ for all the segments $i=0\rightarrow Q-1$ in the first pass.

The invention also proposes a closed loop LTP analysis process with perceptual filtering of performances equivalent to LTP analysis by adaptive dictionary and of reduced complexity, based on the following expression of the error signal, whose energy is minimized:

$$e(n)=h_s(n)*(r(n)-\beta\tilde{e}(n-\lambda))$$

the points preceding the current subblock (such that n<0 if the current subblock commences at n=0) between the points $\tilde{e}(n-\lambda)$ (λ optionally being fractional, $\tilde{e}$ optionally being extrapolated) and not $\tilde{e}(n)$, as in the case of the adaptive dictionary.

Thus, the invention makes it possible to define a structure on all the delays scanned in the long term prediction module, the thus structured delays being referred to in the invention by the term "pseudo-logarithmic dictionary of LTP delays". It is known that it is pointless from a perceptual standpoint to maintain a great precision on the LTP delays, when said delays increase. The pseudo-logarithmic dictionary according to the invention makes use of this idea and makes it possible to maintain the performance characteristics of uniform dictionaries for a lower flow rate, e.g. it has been found that the performance characteristics of the dictionary D, constituted by 256 elements, were similar to those of all the 960 delays obtained by uniformly sampling the same range of delays with a precision of ⅛, which represents a flow rate gain of more than 20%.

Apart from organizing the previously defined concept, the pseudo-logarithmic structure also makes it possible to establish a simple correspondence between the index of each delay of the pseudo-logarithmic dictionary and its value, facilitating the delay coding and decoding operations. Therefore no storage is necessary for finding the delays in the dictionary.

This structure also facilitates the design of such a dictionary, such a dictionary being totally defined by giving a few parameters. For a given application, the choice of these parameters is governed by the constraints of the application. It is then easy to determine the pseudo-logarithmic dictionary or dictionaries appropriate for this application.

The present invention also describes a relatively simple process permitting the implementation of a scanning module for such a dictionary. Although of a suboptimim nature, such a technique has revealed performance characteristics equivalent to the optimum search. The complexity reduction obtained with this process is important. On comparing the calculation times in a CELP-type coder of the two following techniques:

- reference technique: LTP analysis by adaptive code book with selection of the optimum delay by the autocorrelation method as defined in the article by Kleijn, Krasinski and Ketchum entitled "Fast Methods for the CELP Speech Coding Algorithm", referred to hereinbefore;
- technique proposed by the invention: LTP analysis using a suboptimum procedure.

Although not producing the same results, these two techniques have been considered to have an equivalent subjective quality.

On a microcomputer, the processing of the LTP module using the technique proposed in the invention is three times faster than that of the module using an optimized version of the reference technique. This optimized version utilizes to the maximum the methods making it possible to reduce the complexity of the reference technique. On comparing the calculation times of the non-optimized version of the reference technique with those of the proposed technique, a gain greater than 11 is obtained.

BRIEF DESCRIPTION OF THE DRAWINGS

FIG. 6 shows the dictionary D.

DETAILED DESCRIPTION OF EMBODIMENTS

The present invention relates to a digital device for coding speech of the predictive coder type using a short term prediction of the signal permitting the modelling of the formants, a long term prediction for restoring the fine structure of the spectrum and then a coding of the residual wave with the aid of the synthesis-based analysis method. A general description of such coders is given in the articles by Kroon and Atal referred to hereinbefore. The short and long term predictors are calculated by linear prediction methods known under the terms LPC (Linear Prediction Coding) and LTP (Long Term Prediction).

Figure 1A:
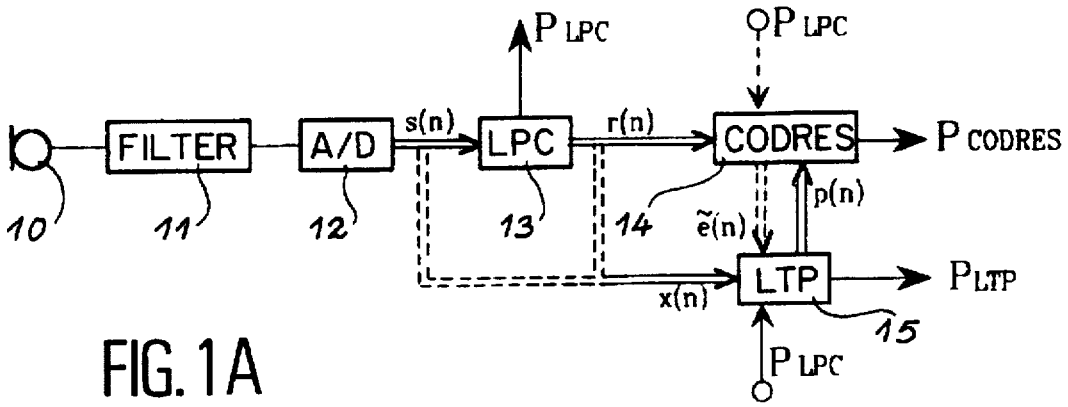
FIGS. 1A and 1B show the speech coding device and decoding device according to the invention.
Figure 1B:
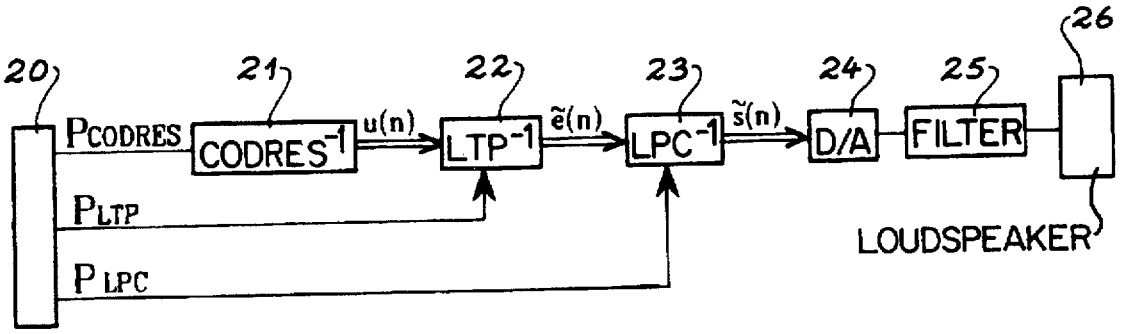

FIGS. 1A and 1B show a digital coding device and a digital decoding device for speech according to the present invention. The coding device successively comprises a sensor 10, a filter 11, an analog-digital converter 12, a LPC module 13, a residue coding module or CODRES 14, a LTP module 15 receiving at the input the input signal or the output signal of the LPC module 13: x(n)=s(n) or r(n) and optionally the reconstructed residual signal $\tilde{e}(n)$ from the CODRES module 14.

This coding device functions in the following way. After conversion into digital form, the analog signal is segmented into frames of $N_O$ samples s(n). These samples are analyzed in the LPC module 13 by a conventional linear prediction method. At the output, module 13 produces PLPC parameters transmitted to the decoder and $N_O$ samples of residual signal r(n).

Then, the LTP module 15 accepts at the input N samples of a signal x(n), which can result from a subsegmenting of the signal s(n) or r(n). When the LTP module 15 operates in closed loop form, it must also be able to receive at the input reconstructed residual samples (or synthesis excitation) resulting from the looping of the residue coding module 14. The LTP module can optionally also use PLPC parameters (adaptive dictionary, perceptual filter). This module 15 produces the PLTP output parameters (quantified gain $\beta$ and index $i_d$ of the delay) and produces a long term prediction signal p(n).

The residue coding module 14 then performs the residual excitation coding. The coding parameters of this excitation are transmitted to the decoder. When necessary, said module 14 comprises a local decoder permitting the calculation of the synthesis excitation (or reconstructed residual) $\tilde{e}(n)$.

FIG. 1B shows the decoding device corresponding to the coding device of FIG. 1A. The decoding device successively comprises a demultiplexing module 20, a residue decoding module or $CODRES^{-1}$21, a LTP (or $LTP^{-1}$) synthesis module 22, a LPC (or $LPC^{-1}$) synthesis module 23, a digital-analog converter 24, a filter 25 and a loudspeaker 26.

The residue decoding module 21 decodes the $P_{CODRES}$ parameters and calculates N samples of a signal u(n). This signal enters the module 22 together with the $P_{LTP}$ parameters, which will be decoded there. After filtering u(n) by 1/P(z), we obtain $\tilde{e}(n)$.

This signal then enters the module 23, which performs the decoding of the $P_{LPC}$ parameters and the filtering of $\tilde{e}(n)$ by 1/A(z). At the output, said module 23 produces $N_O$ samples of the synthesis signal $\tilde{s}(n)$, for one frame, which are converted into analog form.

Figure 2:
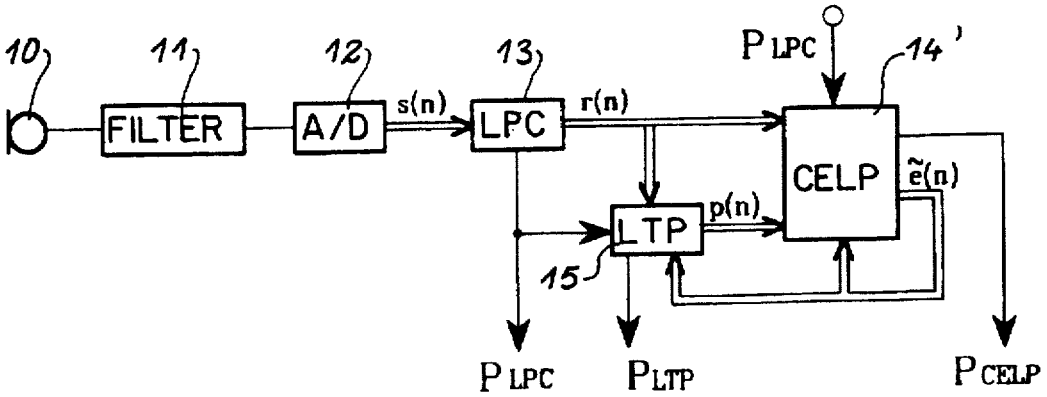
FIG. 2 shows a particularly interesting embodiment of the coding device of FIG. 1A.

Numerous variants of the device according to the invention are possible. Consideration will now be given to a particularly interesting variant, which is shown in exemplified manner in FIG. 2 and has the following features. The LTP analysis (module 13), which will be described in greater detail hereinafter, is a closed loop analysis, using the signals r(n) and $\tilde{e}(n)$ in input, with a perceptual filter calculated on the basis of the $P_{LPC}$ parameters supplied by the LPC module. For residual excitation coding the signals r(n), p(n) and $\tilde{e}(n)$ enter the CELP-type module 14, which uses a standard search procedure in a CELP dictionary in order to quantify the residual signal as described in the aforementioned article of B. S. Atal. Such a dictionary is e.g. formed by $N_F$ Gaussian statistical random wave forms. The parameters $P_{LPC}$ entering the CELP module 14' make it possible to calculate the perceptual filter $W(z)=A(z)/A_\gamma(z)$,($\gamma$=0.75).

After selecting the best wave form or shape of the dictionary, the module 14' produces $P_{CELP}$ parameters (quantified gain and index $i_c$ of the wave form) and the reconstructed residual signal $\tilde{e}(n)=p(n)+\gamma u_{i_c}(n)$.

For a 8kHz sampling frequency, the present variant of the device performs a coding of the speech signal at a rate of 8kbit/s, with the following characteristics:

| | | |
|---|---|---|
| LPC frame | 24 ms (N = 192) | |
| Subframe | 4 ms ($N_0$ = 32) | |
| LPC rate | 42 bits/frame (order 10) | |
| LTP rate | $i_d$: 8 bits<br>$\beta$: 3 bits | 11 × 6 bits/frame |
| Excitation | scale factor: 6 bits/frame<br>CELP $i_c$ index: 10 bits<br>gain $\gamma$: 3 bits<br>($N_F$ = 1024 | 13 × 6 bits/frame |

The present invention relates to the LTP module, whose operation will now be described. The LTP analysis module according to the invention is based on the scanning of a pseudo-logarithmic delay dictionary.

An order 1 LTP analysis module, no matter what the analysis type, calculates the delay $\lambda$ of the predictor P(z), which minimizes a certain error criterion. The present invention groups all the scanned delays in a dictionary having a pseudo-logarithmic structure. These delays $\lambda$ are rational numbers arranged in increasing order in the dictionary.

Figure 3A:
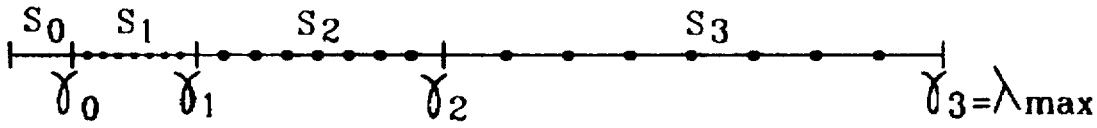
FIG. 3 illustrates the operation of a pseudo-logarithmic delay dictionary.
Figure 3B:
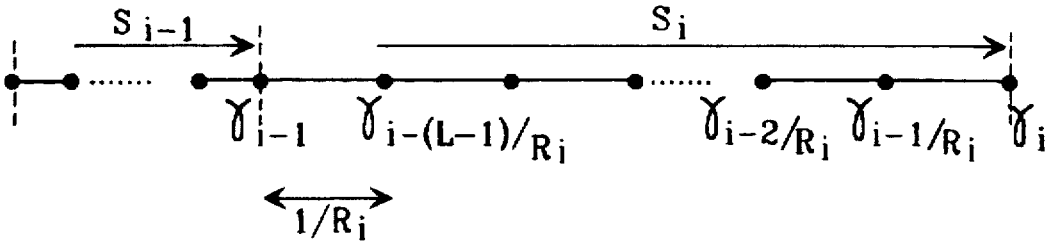

The dictionary is subdivided into Q adjacent segments ($S_i$(i=0→Q−1) each having L delays. To each segment $S_i$ corresponds a resolution $R_i$ and if $\gamma_i$ is the final delay of the segment $S_i$, the segment $S_i$ is followed in the following way, as shown in FIGS. 3A and 3B:

$$S_i=\{\lambda_j=\gamma_i-j/R_i,\ j=L-1\rightarrow 0\} \quad (4)$$

The delay $\gamma_i$ can optionally be fractional, but the delay $\lambda_j$ must prove $\lambda_j.R_i$ integer $\forall i,\forall j$, i.e. for each segment $S_i$, it is sufficient for $\gamma_i.R_i$ to be an integer.

The resolutions of the successive segments decrease in a given rational ratio k:

$$R_i=R_{i-1}/k,\ i=1\rightarrow Q-1 \quad (5)$$

The adjacent condition between these segments (FIG. 3B) is ensured by:

$$\gamma_{i-1}=\gamma_i-L/R_i\ i=1\rightarrow Q-1 \quad (6)$$

On calling $\lambda_{max}$ the final delay of the dictionary ($\lambda_{max}=\lambda_{Q-1}$), it is shown that the condition $\gamma_i R_i \epsilon N$ is satisfied by any i=0 at Q−1 if and only if:

$$R_{Q-1}.\lambda_{max}\epsilon N \quad (7)$$

The dictionary is then totally defined by giving the values {Q=number of segments, L=size of segments, k=resolution decrease factor, $\lambda_{max}$=final delay of dictionary, $R_{Q-1}$= resolution of the final segment such that the equation (7) is proved}.

It is then possible to calculate $\lambda_{min}$ (first delay of the dictionary) by the formula:

$$\lambda_{min} = \lambda_{min} - \left( L \frac{k^Q - 1}{k - 1} \right) / R_0$$

and on defining the length $l_i$ of the segments $S_i$ as $l_i = \gamma_i - \gamma_{i-1}$, we then obtain (FIG. 3B):

$$l_i = k.l_{i-1},\ i = 1 \rightarrow Q-1 \tag{8}$$

The k-based pseudo-logarithmic structure of the delay dictionary appears in equations (5) and (8).

Figure 3C:
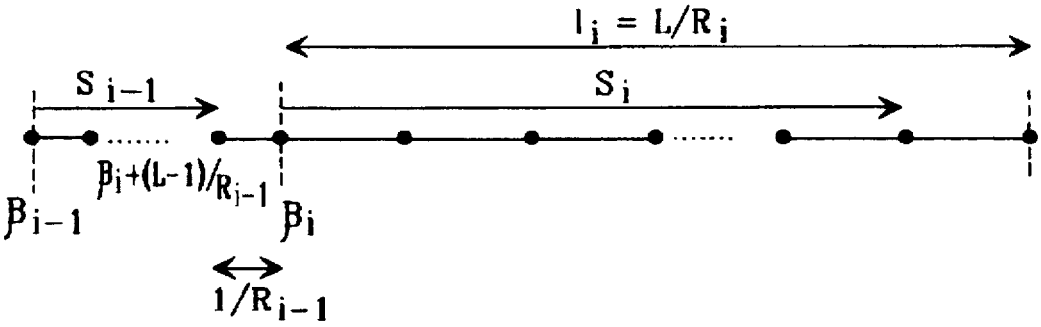

It is possible to form a dictionary of the same type using as a basis the first delay $\beta_i$ of each segment:

$$S_i = \{\lambda_j = \beta_i + j/R_i,\ j = 0 \rightarrow L-1\} \tag{4'}$$

and by defining the adjacency condition by (FIG. 3C):

$$\beta_i = \beta_{i-1} + L/R_{i-1} \tag{6'}$$

It is then necessary to replace the $\lambda_{max}$ by $\beta_{Q-1}$=first delay of the final segment and the condition (7) by:

$$R_{Q-1} \cdot \beta_{Q-1} \in N \tag{7'}$$

Although slightly different, this dictionary is completely equivalent to that described relative to FIG. 3B.

These pseudo-logarithmic delay dictionaries permit a simple coding of the delay which is inexpensive with respect to storage of type:

$$\text{code}(\lambda_j) = L.i + j'.$$

$$\text{with}(\lambda_j = \gamma_i j/R_i) \in S_i \text{ (see equation (4)) and } j' = L-1-j$$

for a dictionary defined by the equations (4), (6) and (7).

A coding of the same type can be performed for a dictionary defined by the equations (4'), (6') and (7').

Consideration will be given hereinafter to an exemplified dictionary, which represents a particularly interesting embodiment of the invention.

D=dictionary with 256 delays (8 bits) such that:

$$\begin{cases} Q = 4 \\ L = 64 \\ k = 2 \\ \lambda_{max} = \lambda^0_{min} + 119 \text{ (with } \lambda^0_{min} = \text{smallest integral delay)} \\ R_3 = 1 \end{cases}$$

All LTP analysis types use a criterion to be minimized, which utilizes a signal $x(n-\lambda)$ for a certain delay $\lambda$ and n=0 at N−1 (in open loop, x(n) represents s(n) or r(n), and in closed loop $\tilde{e}(n)$.

Firstly this signal $x(n-\lambda)$ will be defined in the particular case where the delay $\lambda$ is a rational. In effect, when $\lambda$ belongs to the dictionary defined hereinbefore, it is of form $\lambda = \lambda_1/R$ such that $\lambda_1 \in N$,R rational. R (resolution of the segment which contains $\lambda$) is an a priori random rational of type R=p/q, $p \in N$ and $q \in N$.

Figure 4:
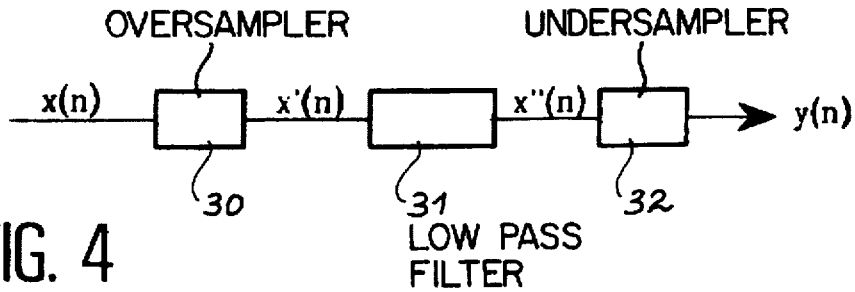
FIG. 4 illustrates the procedure for calculating the signal $x(n-\lambda)$, rational λ intervening in the LTP module.

$x(n-\lambda), n=0 \rightarrow N-1$ is defined by extending the technique described by P. Kroon to the case of a rational resolution R=p/q. There is a passage from the signal x(n) to the signal y(n) of resolution multiplied by x(p/q) with the aid of conventional signal interpolation methods, as described in the aforementioned article of Crochière and Rabiner As shown in FIG. 4, the signal x(n) is firstly oversampled by a factor p in an oversampler 30, producing a signal x'(n), which enters a low-pass filter H(z) 31, whose cut-off frequency is below $f_{max}/\text{Max}(p,q)(f_{max}=f_{sample}/2)$ the signal x"(n) resulting from this filtering is then undersampled by a factor q in an undersampler 32 to give y(n).

We therefore have:

y(n)=x"(nq) with $$x''(n) = \sum_{i=-I}^{i=1} h(i)x'(n-i)$$

if $$H(z) = \sum_{i=-I}^{i=1} h(i)z^{-i}$$

It is also possible to express x"(n) by $$x''(n) = \sum_{i=I/p}^{i=I/p} h(jp+\phi)x(k-j)$$

if $k=E(n/p), n \equiv \phi[p]$.

(One considers the notation E(x)=integral part of x).

For a delay $\lambda = \lambda_1/R$ with $\lambda_1 \in N$, we define $x(n-\lambda)$ by:

$$\begin{aligned} x(n-\lambda) &= y(nR-\lambda_1)\ \forall n \in \{0.1, \ldots, N-1\} \\ &= y(np/q-\lambda_1) \text{ if } R = p/q \end{aligned}$$

then $x(n-\lambda) = x''(np-\lambda_1 q)$

It can be seen that it is of interest to calculate from $(\lambda_1 q)$ the values $\lambda_0 \in N$ and $\phi e\{0,1,\ldots,p-1\}$such that $\lambda_1 q = \lambda_0 p - \phi$:

$$\begin{cases} \lambda_0 = E\left( \dfrac{\gamma_1 q - 1}{p} \right) + 1 \\ \phi = (p-1) - \text{mod}(\lambda_1 q - 1, p) \end{cases}$$

[The notation q=mod(p,n) means q=residue of p modulo n]

Then $$x(n-\lambda) = \sum_{j=-I/p}^{I/p} h(jp+\phi)x(n-\lambda_0-j), n = 0 \rightarrow 1 \tag{9}$$

In practice, one e.g. chooses for H(z) a windowed cardinal sine sampled by a factor Max(p,q). The p filters $\{h_\phi(j), j=-I/p \rightarrow I/p\}$, $\phi=0 \rightarrow p-1$ are polyphase filters constructed on the basis of H(z).

When p>q, we then have $h_0$ defined by $\{h_0(0)=1$, and $h_0(j)=0$ if $j \neq 0\}$and therefore for integral values of $\lambda$, we find for $x(n-\lambda)$ the signal x(n) displaced by $\lambda$ points. For q=1, we again obtain the expression given hereinbefore in connection with high resolution LTP analysis.

A description will now be given of the search process for the optimum delay in the pseudo-logarithmic dictionary defined in the present invention. No matter what the LTP analysis type, the optimum delay search amounts to minimizing a criterion:

$$E(\lambda)=\sum_{n=0}^{N-1} e(n)^2$$

If one defines in general terms e(n) as: $e(n)=v(n)-\epsilon x(n-\lambda)$, v(n) being a known signal independent of λ and $x(n-\lambda)$ defined for each candidate delay λ, the expressions of these two signals are dependent on the analysis type used, then the minimization of E(λ) amounts to maximizing:

$$E'(\lambda)=\sum_{n=0}^{N-1} v(n)^2-E(\lambda)$$

The optimum delay search necessitates the calculation for each delay λ of the two quantities:

$$N(\lambda)=\sum_{n=0}^{N-1} v(n)x(n-\lambda)$$

$$D(\lambda)=\sum_{n=0}^{N-1} x(n-\lambda)^2$$

N(λ) and D(λ) respectively represent the numerator and the nominator of the optimum gain β associated with each delay λ. These two quantities intervene in E'(λ). For example, when β is not loop-quantified, we obtain $E'(\lambda)=N(\lambda)^2/D(\lambda)$.

In all cases, the evaluation of E'(λ) for each delay λ is a procedure requiring numerous calculations, particularly when use is made of non-integral delays and in the case of closed loop analyses, as soon as it is necessary to extrapolate the signal $\tilde{e}(n)$.

Various methods have been proposed for reducing the complexity of this search.

High resolution LTP analysis: calculation of the criteria $E'(\lambda_0)$ such that $\lambda_0 \epsilon N$ and interpolation of the criteria, as described in the aforementioned article of P. Kroon and B. S. Atal. This is an approximate method and remains relatively complex.

Adaptive dictionary: extension of the summation in E'(λ) for using an autocorrelation method as defined in the article by A. Le Guyader, D. Massaloux and J. P. Petit entitled "Robust and Fast Code Excited Linear Predictive Coding of Speech Signals" (Proc. ICASSP, pp. 120–123, May 1989), "Backward Filtering" for the calculation of numerators as defined in the article by I. M. Trancoso and B. S. Atal entitled "Efficient Procedures for Finding the Optimum Innovation in Stochastic Coders" (Proc. ICASSP, pp. 2375–2378, April 1986), recurrence in the calculation of denominators, as described in the article by W. B. Kleijn, D. J. Krasinski and R. H. Ketchum entitled "An Efficient Stochastically Excited Linear Predictive Coding Algorithm for High Quality Low Bit Rate Transmission of Speech" referred to hereinbefore. However, these procedures are disturbed by the introduction of extrapolated $\tilde{e}(n)$ signals and this becomes more complicated with the use of fractional delays.

It is therefore of interest to further simplify this search procedure and, in the framework of the delay dictionary according to the invention, to use as a basis for this its special structure.

Figure 5:
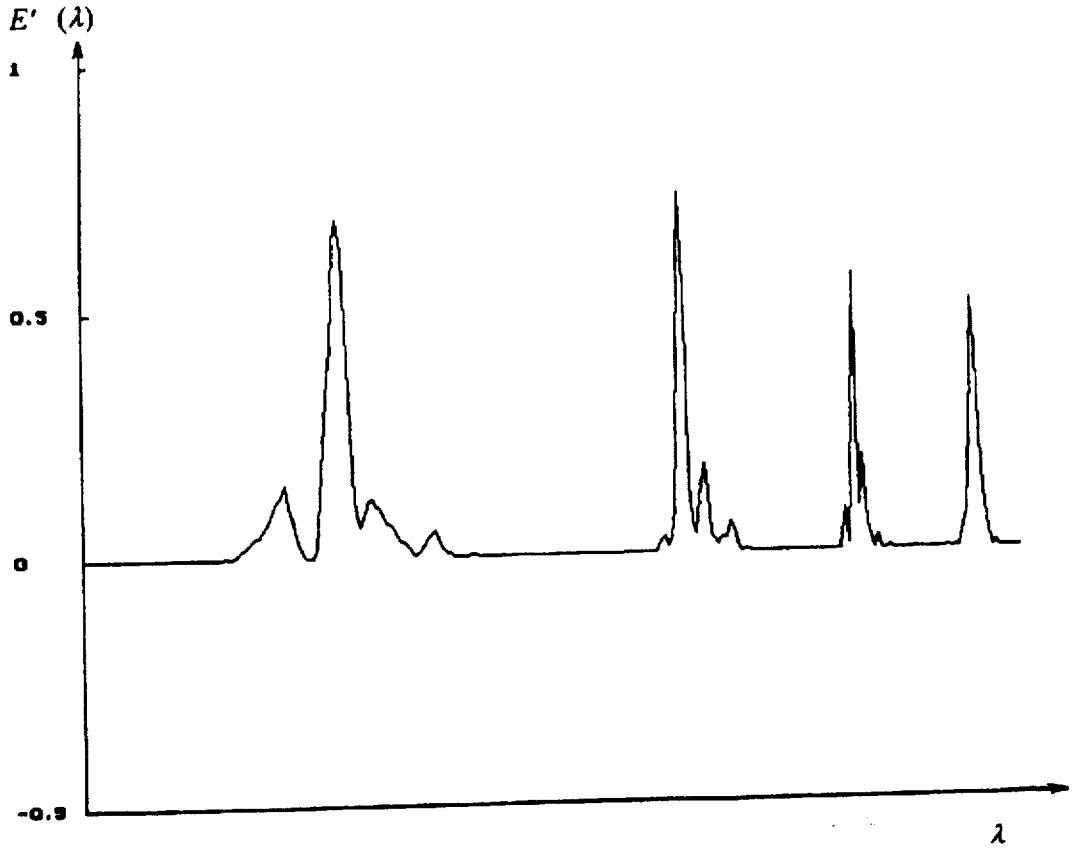
FIG. 5 shows on a real speech sequence, the evolution of the criterion $E'(\lambda)$, when λ passes through the dictionary D.

On studying the evolution of the criterion E'(λ) for λ varying in a delay dictionary according to the invention as defined hereinbefore, it is found that the curve $E'_n(\lambda)$ with $$E'_n(\lambda)/\sum_{n=0}^{N-1} v(n)^2$$

has a pseudo-logarithmic structure and that its maxima are relatively flattened. For example, FIG. 5 shows the evolution of $E'_n(\lambda)$ for λε dictionary D, on a voiced frame of a speech sample. This study suggests the subdivision of the search into the two following passes:

- in a first pass: in each segment $S_i$, calculation of the criterion on a restricted number α(i) of delays such that $\forall i=1\rightarrow Q-1.\alpha(i)=k\alpha(i-1)$, and selection of a certain number K(i) of local maxima for each segment;
- in a second pass: scan limited to the vicinity of the local extremes selected in the first pass and for each segment.

Obviously, the progression $\alpha(i)=k\alpha(i-1)$ is limited by L: if on the basis of $i_L$ we obtain $\alpha(i)\geqq i_L$, then α(i)=L for $i\geqq i_L$ and the suboptimum search in two passes is replaced by an optimum search in a single pass for the segments $i_L$ at Q−1.

One case is more particularly interesting: when L is a multiple of $k^{iL-1}$, then the choice for α(0) of $L/K^{iL-1}$ or a submultiple of $L/K^{iL-1}$ introduces a regular spacing of the delays scanned in the first pass. It is then demonstrated that these delays form together:

$$\left\{ \lambda_0-L/R_0+jxa, j=1\rightarrow\frac{k^{iL}-1}{k-1}\ \alpha(0) \right\}$$

the spacing α being equal to $L/(R_0\alpha(0))$.

In the particular case of the dictionary D, this two-pass scanning technique is introduced in the following way:

For this dictionary L=64, $k^{Q-1}=8$, $R_0=8$. The choice α(0)=8 makes it possible to scan in the first pass a subset DO of D constituted by regularly spaced delays of D with a spacing α=1. It is demonstrated that $\gamma_0=\lambda^0_{min}+7$ and that DO is in fact formed from 120 consecutive integral delays $\{\lambda_0=\lambda^0_{min}+j, j=0\rightarrow 119\}$ extracted from the dictionary D.

It is possible to introduce a supplementary simplification in the first pass search. The maximization of $E'(\lambda)=N(\lambda)^2/D(\lambda)$ is replaced by that of N(λ). The standardization resulting from the division by D(λ) is generally superfluous in this first pass which is essentially more approximate than the complete search. Therefore, interest is attached to the local maxima of the intercorrelation N(λ) for all the segments $i=0\rightarrow Q-1$ in the first pass.

However, the second pass uses the complete criterion E'(λ) and must also be performed on all the segments, even for the segments $i\geqq i_L tq\alpha(i)\geqq L$, because it is necessary to evaluate E'(λ) on the local extremes of N(λ) selected in the first pass.

The very high performance, adaptive dictionary LTP analysis is also very complex, due to the presence of the closed loop on the one hand and the perceptual filter on the other. A variant of this analysis, reducing the intrinsic complexity of the process without deteriorating the subjective performance characteristics is proposed here. It is based on a modification of the expression (3) of the error signal, whose energy is minimized (criterion E(λ) to be minimized).

Thus, it is possible to retain the use of a perceptual filter without completely subscribing to the CELP philosophy of the adaptive dictionary by taking $$e(n)=h_g(n)*(r(n)-\beta\tilde{e}(n-\lambda)) \quad (10)$$

In this expression, the signal $\tilde{e}(n-\lambda)$ ($\lambda$optionally fractional, $\tilde{e}$ optionally extrapolated) is continuous at the frontier of the subblock: the points preceding the current subblock (tqn=0→N−1) are points ($\tilde{e}(n-\lambda)$,n<0), and not ($\tilde{e}(n)$,n<0) as in the case of the adaptive dictionary.

The interest of this variant is in the possibility of "prefiltering" $\tilde{e}(n)$, the perceptual filter varying at the LPC frame frequency, several LTP analyses being performed in a LPC frame, a same filtered sample $\tilde{e}_w(n)=h_g(n)*\tilde{e}(n)$ being used for several LTP analyses.

With regards to the fractional delays, use is made of the switchability of linear filters and the interpolation filter is applied to the prefiltered samples $\tilde{e}_w(n)$ (this is not applicable to samples using an extrapolated signal $\tilde{e}(n)$).

A description will now be given of a particularly interesting embodiment of the present invention, the aforementioned dictionary D firstly being described in detail. The scanning of this dictionary is presented with the accelerated procedure described within the framework of the above-defined LTP analysis. The thus designed LTP module is integrated, in exemplified manner, into the coding device described hereinbefore.

This dictionary was defined hereinbefore. Its delays are of the fractional type, of resolution R=p>1, or integers. It is possible to describe D in the following way (FIG. 6): each segment $S_i$, i=0→3 of resolution $R_i=2^{3-i}$is formed from delays $\lambda_0-\phi/R_i,\phi=0\rightarrow1$, the integral delays $\lambda_0$ forming a subset $S_i^0$of $S_1$having $n_i=2^{i+3}$ elements:

$$S_i^0=\lambda_0=\left(\mu_i+\gamma_j=0\rightarrow n_i \text{ with } \mu_i=\lambda_{min}^0+\sum_{j=0}^{i-1}n_j \text{ by setting } n_{-1}=0\right).$$

A single interpolation filter H(z) is necessary for the complete dictionary and in practice we take:

h(i)=w(i).sin(iπ/8).(8/iπ,i=I→I, w(i) being a windowing function and I being a multiple of 8:I=8J. The following filters are defined:

$$h_\phi(j)=h(-I+8j+\phi),j=0\rightarrow2J-1 \text{ and } \phi=1,2,\ldots,7.$$

Figure 7A:
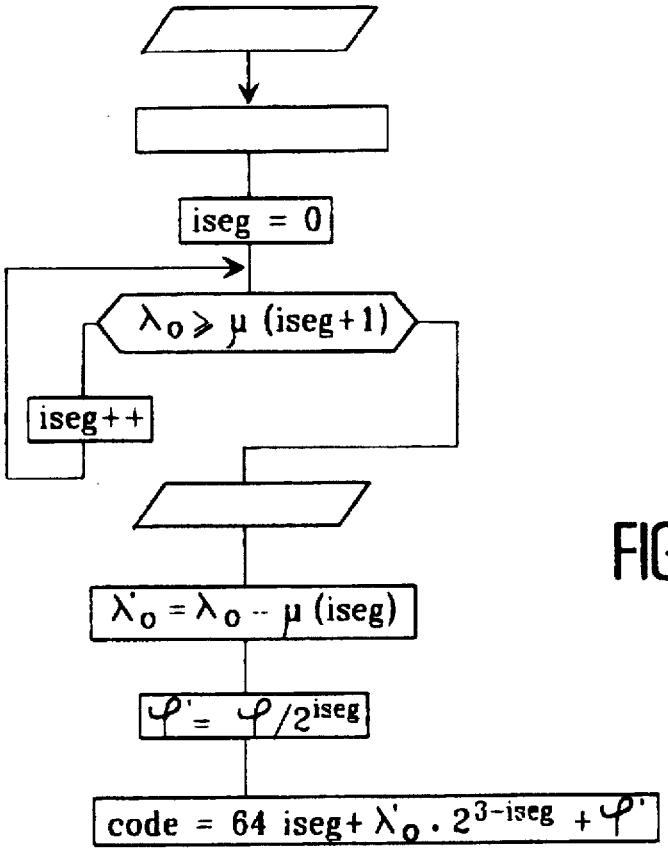
FIG. 7 shows a procedure for coding and decoding the delays of the dictionary D.
Figure 7B:
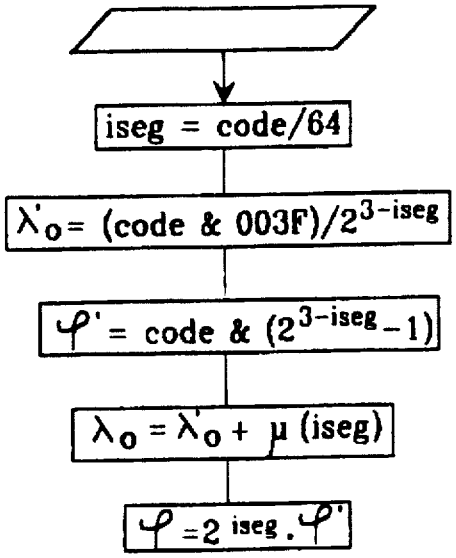

The coding and decoding algorithms of the delays of this dictionary D are given in FIG. 7 and are established in a simple manner with the aid of shifts and logic operators, using the table of four values $\mu_i$(first integral delay in each segment). The code described here disturbs the natural order of the delays in the dictionary without this in any way changing the preceding description.

$$\lambda=\lambda_0-\phi/8\epsilon D\lambda_0\epsilon N,\phi\epsilon\{0,1,\ldots,7\}$$

$$\lambda'_0=\lambda_0-\mu(\text{iseg})$$

Reset with isegε{0, 1, 2, 3}=$n^0$ segment $$\phi'=\phi/2^{iseg}$$

We then have:

$$\text{code } \lambda=[\text{iseg(2bits)}, \lambda'_0(3+\text{iseg bits}), \phi'(3-\text{iseg bits})]=8 \text{ bits}$$

The LTP analysis uses the modified criterion calculated on the basis of the equation (10) and therefore uses a signal $\tilde{e}_w(n-\lambda)=h_g(n)*\tilde{e}(n-\lambda)$, n=0→N−1, λ which is optionally fractional. The signals $\tilde{e}(n)$ and $\tilde{e}_w(n)$ for n<0 are known.

Figure 8A:
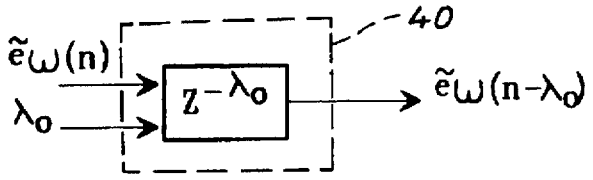
FIG. 8 describes the calculation modules for the signal $\tilde{e}_w(n-\lambda)$ intervening in the search for the optimum delay of D.

As a function of the values of λ, the calculation of $\tilde{e}_w(n-\lambda)$ uses one of the four following processes:

Delay $\lambda=\lambda_0$ integer ≧N:ETW0 module 40 (cf. FIG. 8A)

$\tilde{e}_w(n-\lambda_0)$ is known.

Figure 8B:
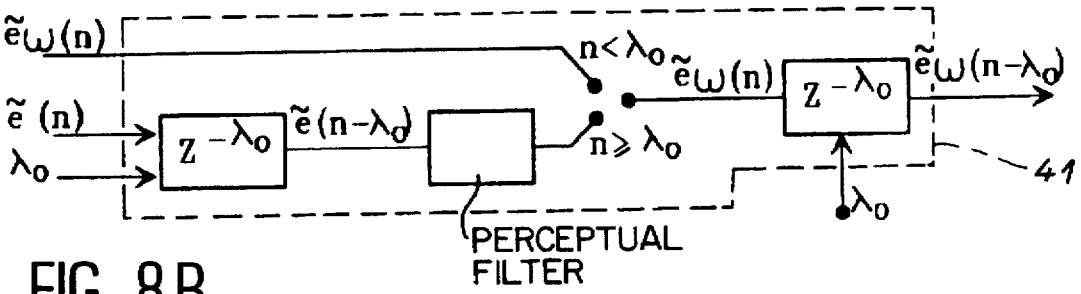

Delay $\lambda=\lambda_0$ integer<N:ETW1 module 41 (cf. FIG. 8B)

if $n<\lambda_0$: $\tilde{e}_w(n-\lambda_0)$ is known if $\lambda_0\leqq n<N$: extrapolation of $\tilde{e}(n-\lambda_0)$:$\tilde{e}(n-k\lambda_0)$ with k=smallest integer with $n<k\lambda_0$ and then filtering by $H_g(z)$.

Figure 8C:
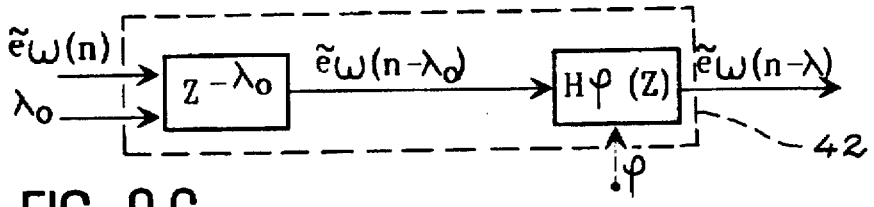

Delay $\lambda=\lambda_0-\phi/8$ fractional, $\lambda_0\geqq N+J$: ETW2 module 42 (cf. FIG. 8C)

$$\tilde{e}_w(n-\lambda)=\sum_{j=0}^{2j-1}h_\phi(j)\tilde{e}_w(n-\lambda_0+J-j) \tag{11}$$

Figure 8D:
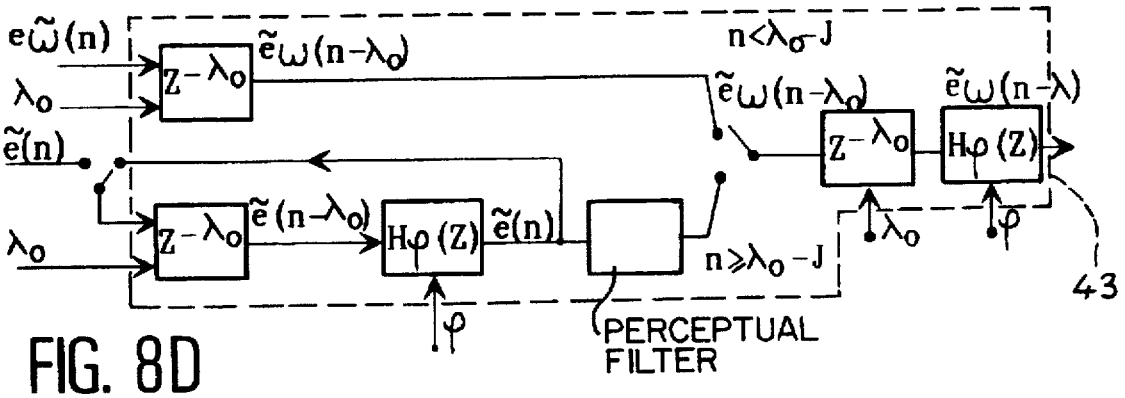

Delay $\lambda=\lambda_0-\phi/8$ fractional, $\lambda_0<N+J$: ETW3 module 43 (see FIG. 8D)

if $n<\lambda_0-J$: $\tilde{e}_w(n-\lambda)$ is calculated by equation (11)

if $\lambda_0-J\leqq n<N$: $\tilde{e}$is completed recursively by:

$$\tilde{e}(0)=\tilde{e}-\lambda)=\Sigma h_\phi(j)\tilde{e}_w(-\lambda_0+J-j) \text{ then } \tilde{e}(n)=Pe(n-\lambda) \text{ for } n=1\rightarrow(N-1-\lambda_0+J)$$

$\tilde{e}_w(n-\lambda)$ is then obtained by filtering $\tilde{e}(n-\lambda)$ by $H_g(z)$.

In the ETW0, ETW1, ETW2 and ETW3 modules shown in FIGS. 8A, 8B, 8C and 8D we have:

$$Hg(z)=\Sigma hg(i)z^{-i} \text{ perceptual filter}$$

$$H_{100}(z)=\Sigma h\phi(i)z^{-i} \text{ polyphase filter.}$$

The two-pass search follows the principle described hereinbefore.

As stated hereinbefore, the dictionary D has the advantage of permitting (by choosing α(0)=8 the coincidence between the set of delays scanned in the first and the set of integral delays of D (i.e.

$$\bigcup_{i=0}^{3}$$

$S_i^0$ in the preceding description).

The first pass, performed solely on the numerators $N(\lambda_0)$ is very fast, because it involves no interpolation operation.

The choice of $\lambda^0_{min}$=N−8 is particularly interesting, because it restricts to the first segment of D the need to extrapolate $\tilde{e}(n)$ in the first pass.

The LTP module given in exemplified manner here is integrated into the device defined hereinbefore as a particularly interesting embodiment of the invention. We take $\lambda^0_{min}$=N−8=24 and J=2:H(z) is a FIR (finished impulse response filter) of length 33.

The number K(i) of local maxima retained in each segment $S_i$ during the first delay search pass is indicated in the following table. These values result from the observation on a certain number of speech samples of the number of maxima of $N(\lambda_0)$ which must be retained in order to ensure the presence of the optimum delay in the vicinity thereof.

| $i/S_i$ | K(i) |
|---|---|
| 0 | 1 |
| 1 | 1 |
| 2 | 2 |
| 3 | 1 |

Figure 9:
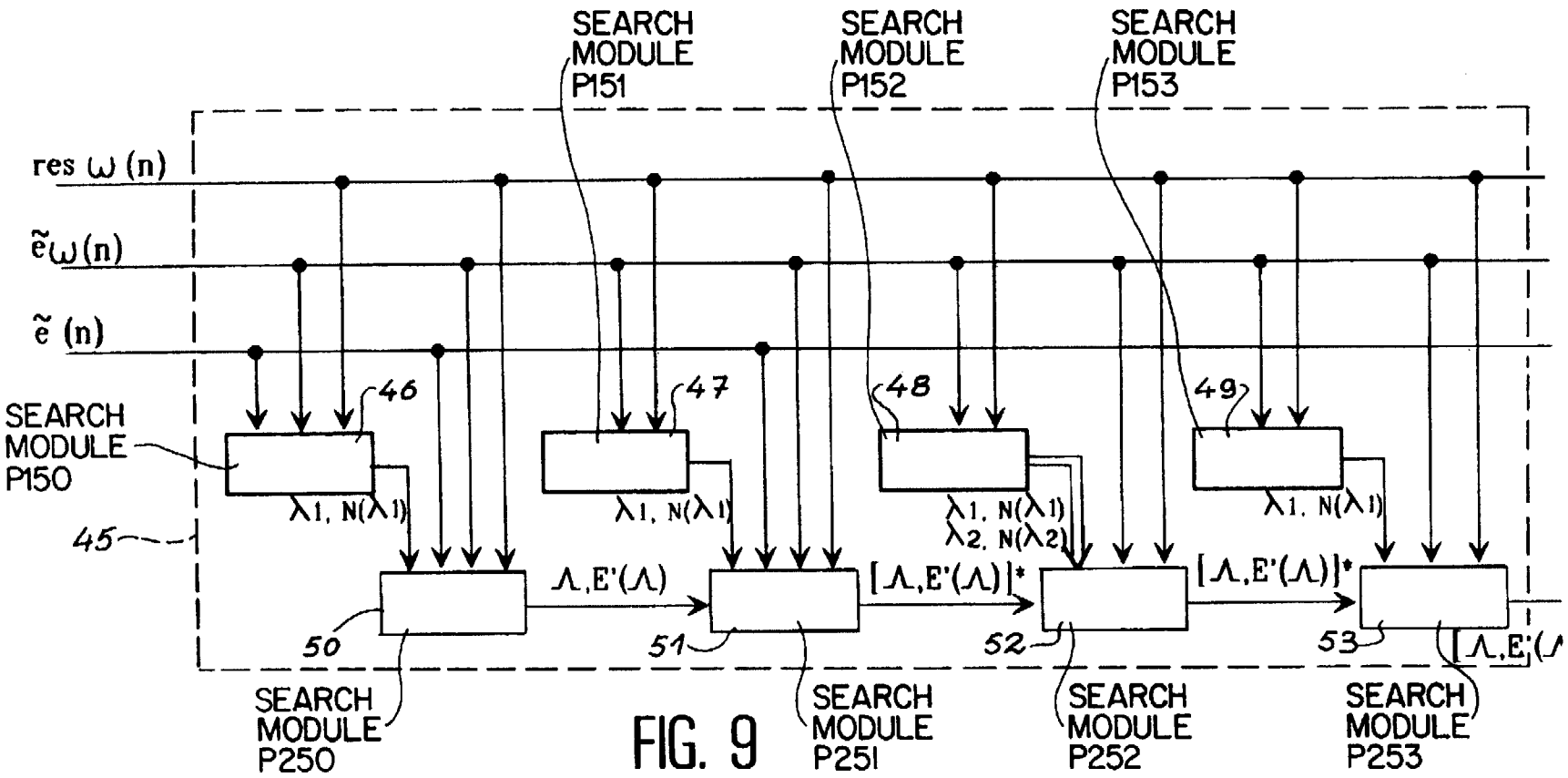
FIGS. 9 to 12 show the operation of said search for the delay in the realization of the LTP module.

The complete search procedure for the delay in D with respect to the present example is described in FIG. 9. The signals resw(n), $\tilde{e}_w(n)$ and $\tilde{e}(n)$ enter the search module 45. At the output of said module 45 there is the selected delay Λ and the associated criterion E'(Λ). We have the following notation in FIG. 9:

Λ,E'(Λ):sought delay Λ and associated criterion

[Λ,E'(Λ)]*:Λ and E'(Λ) optionally updated.

$$\lambda^{0}_{min}=N-8$$

Figure 10A:
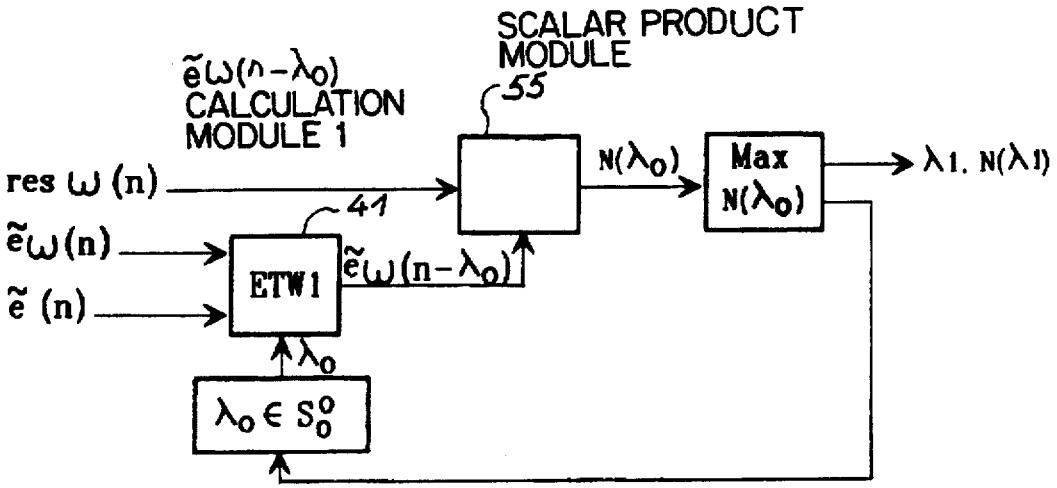
Figure 10B:
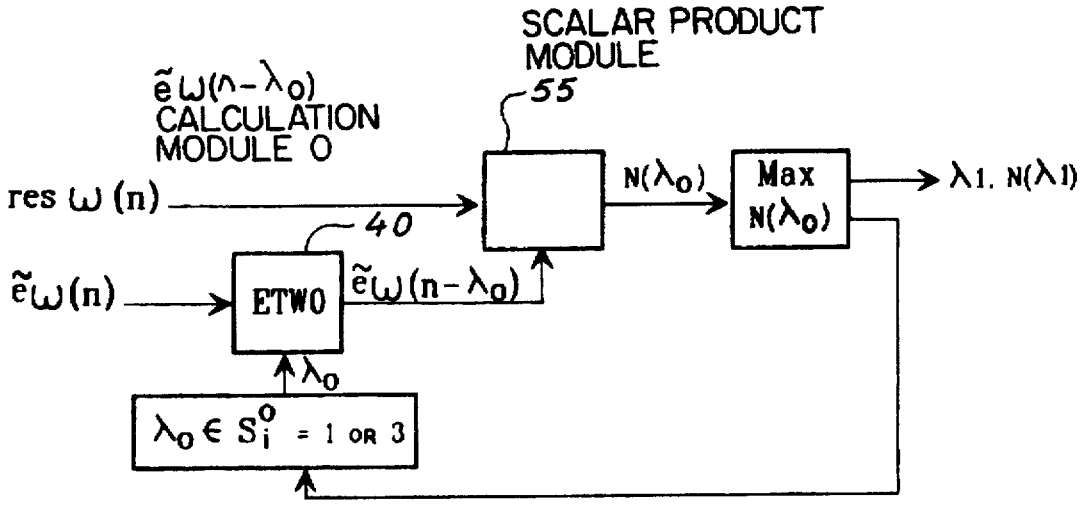
Figure 10C:
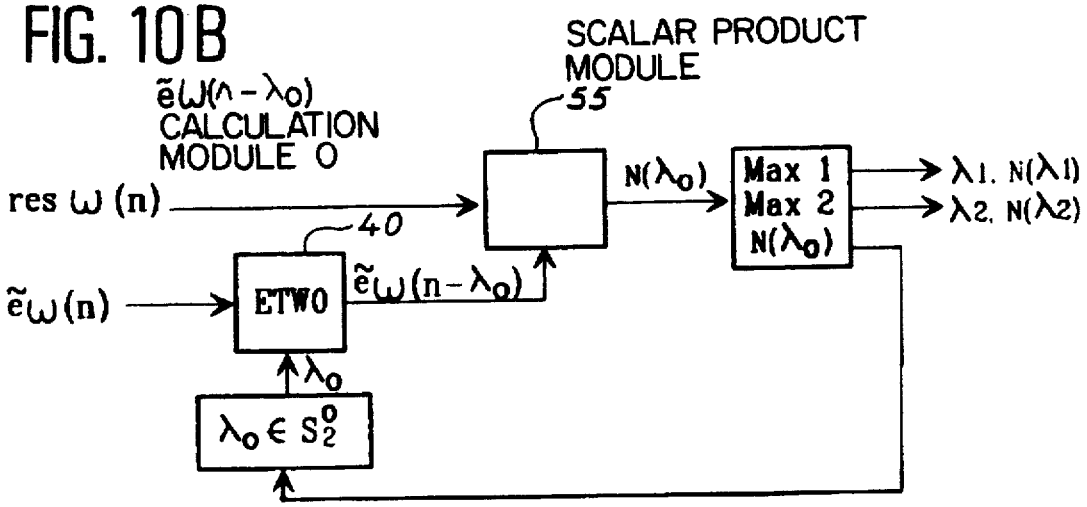
Figure 11A:
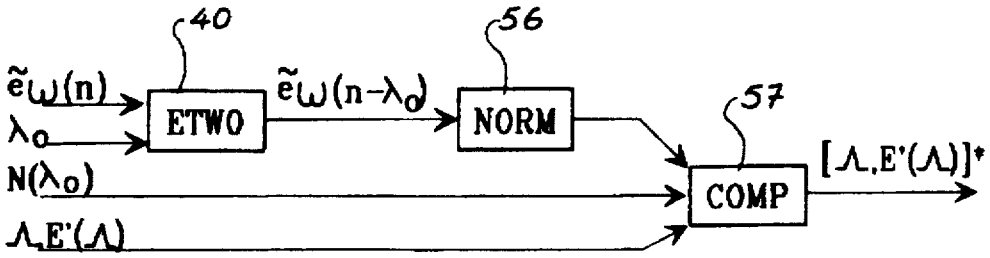
Figure 11B:
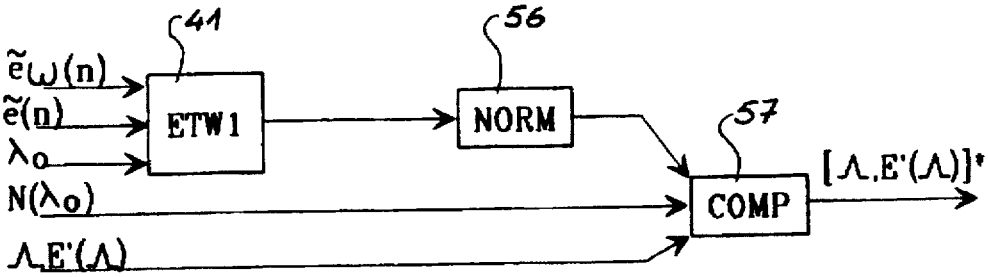
Figure 11C:
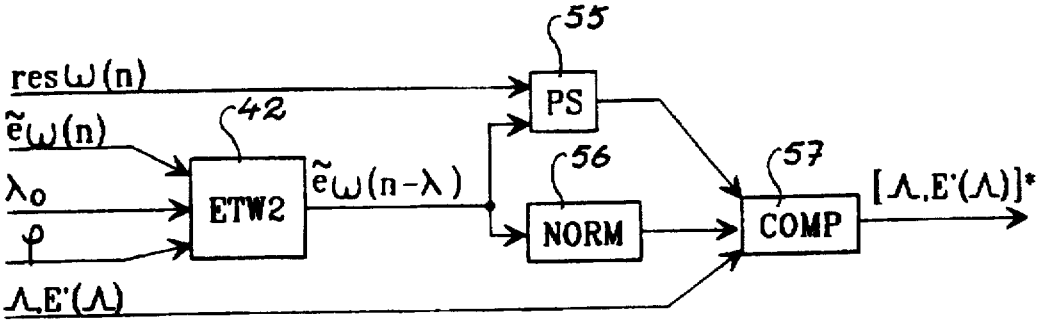
Figure 11D:
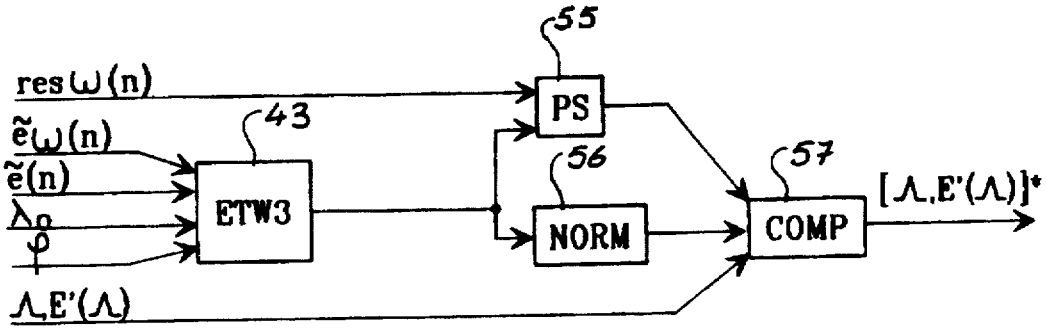
Figure 12A:
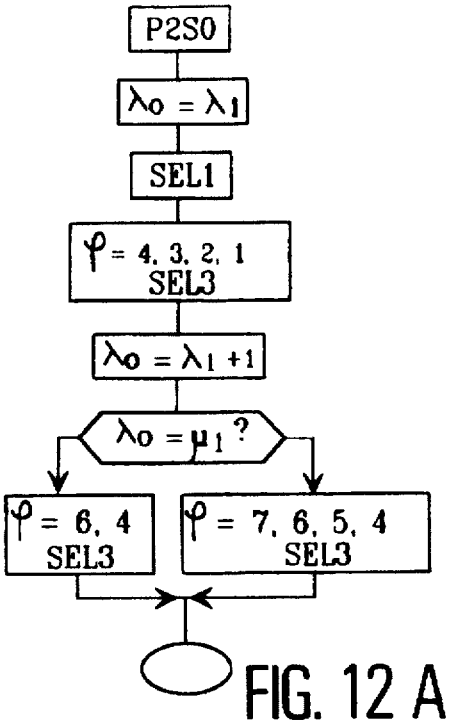
Figure 12C:
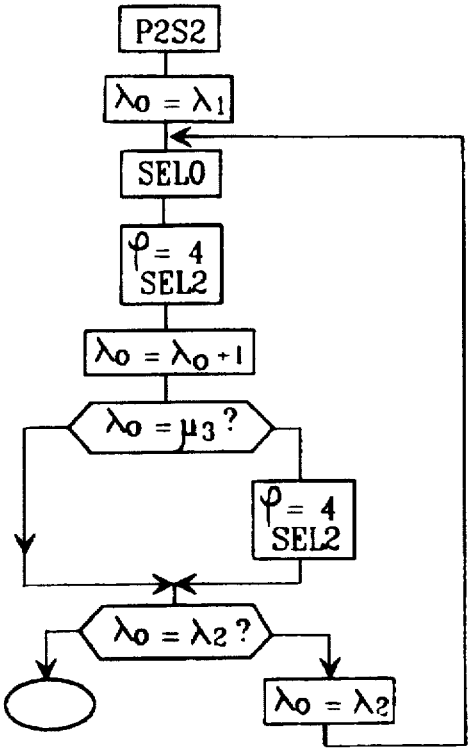
Figure 12B:
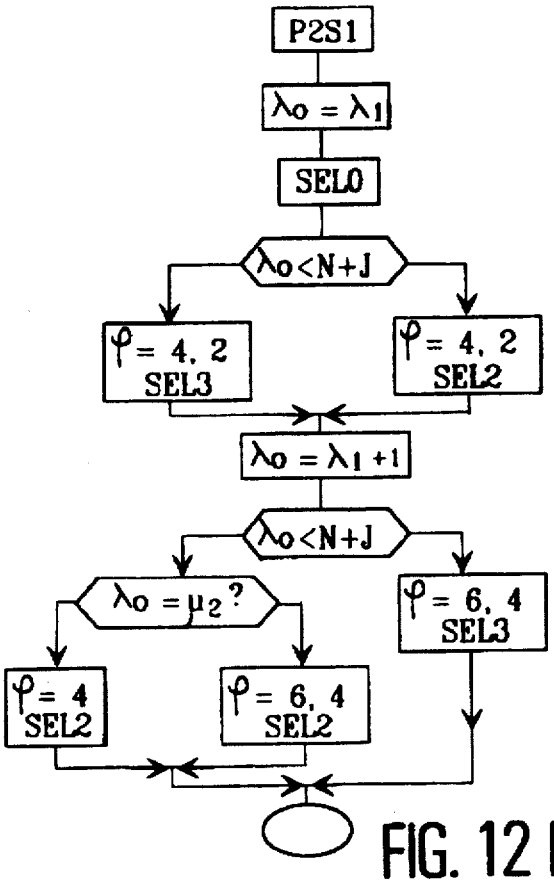
Figure 12D:
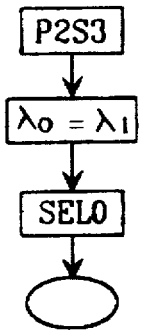

The modules P1Si,i=0 to 3 designated 46, 47, 48 and 49 perform the first search pass on the segments Si. Their detailed operation is shown in FIG. 10. At the output these modules produce K(i),i=0 to 3 (1 or 2) values of selected integral delays $\lambda_1$and the associated intercorrelation values $N(\lambda_1)$.

The second search pass is described by the modules $P2S_i$,i–0 to 3 respectively designated 50, 51, 52 and 53. At the input of said modules, apart from the signals resw(n), $\tilde{e}_w(n)$ and $\tilde{e}(n)$, one finds the outputs of the corresponding modules P1Si. Each module P2Si performs the maximization of the criterion E'(Λ) and outputs the delay Λ associated with the maximum criterion.

FIGS. 12A, 12B, 12C and 12D show the operation of the modules P2Si, which use the selection modules SELj,j=0 to 3 described respectively by FIGS. 11A, 11B, 11C and 11D:

SEL0 has the calculations performed for an integral delay, when no extrapolation of $\tilde{e}_w(n)$ is necessary;

SEL1 has the calculations performed for an integral delay with extrapolation of $\tilde{e}_w(n)$;

SEL2 presents the calculations performed for a fractional delay when no extrapolation of $\tilde{e}_w(n)$ is necessary;

SEL3 presents the calculations performed for a fractional delay with extrapolation of $\tilde{e}_w(n)$.

The modules PS 55 calculate the scalar product $$\sum_{n=0}^{N-1} resw(n)\tilde{e}w(n-\lambda_0).$$

The modules NORM 56 calculate the energy $$\sum_{n=0}^{N-1} \tilde{e}w\,(n-\lambda)^2.$$

The modules COMP 57 calculate E'(λ) and select Λ=λif e'(λ)>E'(Λ).

The delay value Λ from the second pass is the delay selected by the search module in the dictionary D.

I claim:

1. A closed loop long term prediction process in a speech processing system comprising the steps of:

obtaining a residue signal, r(n), from another process performed on a speech signal that is input to said speech processing system;

obtaining a synthesis excitation signal $\hat{e}(n-\lambda)$ which is continuous at a beginning of a subblock;

calculating an error expression $e(n)=h_g(n)*(r(n)-\beta\hat{e}(n-\lambda))$, where β is an optimum gain associated with each delay, λ, of a set of delays and $h_g(n)$ is a transfer function of a perceptual filter mechanism, wherein said calculating step comprising the step of minimizing an error based on said error expression, e(n).

2. The process of claim 1, further comprising the step of scanning said set of delays, in a dictionary, wherein said dictionary comprises a long term prediction delayed pseudo-logarithmic dictionary comprising said set of delays.

3. The process of claim 2, wherein said scanning step comprises scanning the long term prediction delayed pseudo-logarithmic dictionary, where respective of said set of delays, λ, are arranged in increasing order and in Q segments, each of said Q segments comprise L adjacent of said delays, λ, successive of said Q segments having respective resolutions that decrease geometrically by a rational ratio k, where k>1.

4. The process of claim 1, further comprising the steps of:

scanning a dictionary comprising said set of delays ;and selecting a particular delay from said set of delays.

5. The method of claim 1, further comprising the step of coding said speech signal using a result of said minimizing step.

6. A method for processing a speech signal with a closed loop long term prediction mechanism, comprising the steps of:

transducing an acoustic signal to generate a digital speech input signal;

processing said digital speech input signal with a processing mechanism to obtain a residue signal, r(n);

obtaining a synthesis excitation signal $\hat{e}(n-\lambda)$ which is continuous at a beginning of a subblock;

calculating an error expression $e(n)=h_g(n)*(r(n)-\beta\hat{e}(n-\lambda))$, where β is an optimum gain associated with each delay, λ, of a set of delays, and $h_g(n)$ is a transfer function of a perceptual filter mechanism, wherein said calculating step comprising the step of minimizing an error based on said error expression, e(n).

7. The method of claim 6, wherein said processing step comprising processing said digital speech input signal with a linear predictive coding mechanism.

8. The method of claim 6, further comprising the step of coding said digital input speech signal using a result of said minimizing step.

9. A speech processing system comprising:

means for obtaining a residue signal, r(n), from a speech signal that is input to said speech processing system;

means for obtaining a synthesis excitation signal $\hat{e}(n-\lambda)$ which is continuous at a beginning of a subblock;

means for calculating an error expression $e(n)=h_g(n)*(r(n)-\beta\hat{e}(n-\lambda))$, where β is an optimum gain associated with each delay, λ, of a set of delays, and $h_g(n)$ is a transfer function of a perceptual filter mechanism; and said means for calculating comprising means for minimizing an error based on said error expression, e(n).

10. The speech processing system of claim 9, further comprising means for coding said speech signal using a result from said means for minimizing.

11. A speech processing system comprising:

a transducer that converts an acoustic signal to a digital speech input signal;

means for processing said digital speech input signal to obtain a residue signal, r(n);

means for obtaining a synthesis excitation signal $\hat{e}(n-\lambda)$ which is continuous at a beginning of a subblock; and a closed loop long term predication mechanism, comprising means for calculating an error expression $e(n)=h_g(n)*(r(n)-\beta\hat{e}(n-\lambda))$, where β is an optimum gain associated with each delay, λ, of a set of delays, and $h_g(n)$ is a transfer function of a perceptual filter mechanism, wherein said means for calculating comprises means for minimizing an error based on said error expression, e(n).

12. The speech processing system of claim 11, further comprising means for coding said digital speech input signal using a result from said means for minimizing.

* * * * *